United States Patent [19]

Koza et al.

[11] 4,401,913

[45] Aug. 30, 1983

[54] DISCHARGE LAMP WITH MOUNT PROVIDING SELF CENTERING AND THERMAL EXPANSION COMPENSATION

[75] Inventors: Francis R. Koza, Salem; Richard A. Parrott, Merrimack, both of N.H.

[73] Assignee: GTE Products Corporation, Stamford, Conn.

[21] Appl. No.: 270,153

[22] Filed: Jun. 3, 1981

[51] Int. Cl.[3] ..... H01J 61/52

[52] U.S. Cl. ..... 313/25; 313/26; 313/27; 313/634

[58] Field of Search ..... 313/220, 25, 26, 27

[56] References Cited

U.S. PATENT DOCUMENTS

| | | | |
|---|---|---|---|
| 2,228,327 | 1/1941 | Spanner | 313/27 X |
| 3,706,901 | 12/1972 | De Neve | 313/220 X |
| 3,906,272 | 9/1975 | Collins et al. | 313/220 X |

FOREIGN PATENT DOCUMENTS

| | | | |
|---|---|---|---|
| 2332275 | 1/1974 | Fed. Rep. of Germany | 313/201 |

*Primary Examiner*—Palmer C. Demeo

*Assistant Examiner*—Sandra L. O'Shea

*Attorney, Agent, or Firm*—Edward J. Coleman

[57] ABSTRACT

A high pressure sodium vapor discharge lamp having an arc tube coaxially mounted within an outer glass envelope by means including a coiled spring engaging one end of the arc tube and coaxially disposed in the partially compressed state between that end of the arc tube and a dome portion of the outer envelope. In one embodiment the dome of the outer envelope is disk-shaped and a large diameter end of the coiled spring bearing against the dome is constrained in a coaxially centered position by the sidewalls of the outer envelope. In another embodiment, the dome of the outer envelope is provided with an inwardly projecting dimple about which the coiled spring is coaxially fitted to provide self-centering of the arc tube. The partially compressed spring compensates for arc tube length variations and thermal expansion. Mount shadows are reduced by connecting the remote terminal of the arc tube to a lead-in conductor through a fine diameter helically bent wire extending through the outer envelope beyond the length of the arc tube.

9 Claims, 4 Drawing Figures

DISCHARGE LAMP WITH MOUNT PROVIDING SELF CENTERING AND THERMAL EXPANSION COMPENSATION

BACKGROUND OF THE INVENTION

This invention relates to arc discharge lamps, and more particularly, to a discharge lamp having an improved mount for coaxially supporting an arc tube within an outer envelope in a manner which is self-centering and provides thermal expansion compensation.

The present invention is particularly useful in the mounting of arc tubes in high pressure sodium vapor arc discharge lamps. Such lamps employ a relatively long tubular arc tube of narrow diameter and composed of polycrystalline alumina. Internal electrodes at each end of the arc tube are respectively connected to external terminals comprising niobium feed-through tubes. U.S. Pat. Nos. 3,623,134, 3,996,487 and 4,037,129 illustrate prior methods of coaxially supporting the arc tube within the outer envelope by means including a rather heavy metal frame member having spring fingers disposed at one or both ends of the lamp for resiliently engaging the inner wall of the outer envelope to aid in positioning the arc tube. In two of the aforementioned patents, the base-facing niobium tube terminal of the arc tube is supported on a rod or heavy conductor wire projecting from the base; in the other patent, the base-facing terminal of the arc tube is connected through a multi-segment arrangement including a flexible lead wire. In all three patents, the dome-facing terminal of the arc tube is connected to a rod or legs welded to the supporting frame member.

In another heavy frame type support arrangement which has been widely employed in high pressure sodium discharge lamps, the frame, and thus arc tube, is centered and anchored by means of a resilient clamp secured about an inwardly projecting dimple formed at the dome end of the outer envelope; U.S. Pat. No. 3,384,798 provides an example for such a mounting arrangment. Another arc tube mounting arrangement involving a dimple in the dome of the outer glass envelope is described in U.S. Pat. No. 4,117,371, wherein a comparatively heavy conductor wire extends beyond the length of the arc tube and has a loop formed on the end which is wrapped around the dome dimple.

A more simplified arc tube mounting arrangement is shown in U.S. Pat. No. 3,706,901 of De Neve, wherein a lead-in conductor from the base supports the base-facing arc tube terminal, while the dome-facing terminal of the arc tube is connected to the base lead-in wire by means of a terminal wire that includes a helically bent portion which extends along the straight part of the arc tube and a convolute portion which bears against the inner side of the outer envelope dome for centering the arc tube. The thickness of the terminal wire is disclosed as approximately 2 millimeters (about 0.08 inch); hence, the convolute portion, which De Neve shows as being hook-shaped, provides a rather rigid centering member. De Neve refers to the helically bent portion of the terminal wire as an anti-shadow winding, that will expand when heat is generated in the discharge tube, but due to its helical form, the expansion only causes the piece of wire to be bent out further, thereby avoiding the risk of cracks in the outer envelope.

The arc tube of polycrystalline alumina ceramic in a high pressure sodium vapor lamp may be heated in operation to average temperature of 1,000° C. or higher, and the material has a coefficient of linear expansion of $8\times10^{-6}$ per °C. The arc tube is so hot that the only practical way of supporting it is by the inleads extending from the ends. In a lamp having an arc tube which is about 11 centimeters long, for example, the linear thermal expansion of the arc tube can be about 1 mellimeter. Accordingly, it has been found necessary to accommodate differential expansion in order to avoid undue stress on the end terminals and seals which may cause cracks in the alumina arc tube.

The prior art constructions, as described hereinabove, do not adequately allow for a thermal expansion of the arc tube, even though the base-facing niobium tube terminal is not welded to the base support rod. In actual practice on a production line, the arc tube is not perfectly centered, whereupon during thermal expansion, sufficient stress may often be applied to the arc tube whereby cracks are caused in the alumina. Previous approaches to this problem include U.S. Pat. No. 3,882,346, which describes a thermal expansion compensating mounting in which one end of the arc tube is rigidly fastened to a supporting frame, while the other end is secured by an axial lead wire which extends from a ceramic plug through a single close-fitting loop in a transverse support wire, and a flexible conductor provides the electrical connection. U.S. Pat. No. 4,254,355 describes a ceramic arc tube mounting in which the in-lead at one end of the arc tube is fastened to the support rod conductor, while the in-lead at the other end of the arc tube extends through an insulating bushing supported from the rod and connected by a curved flexible conductor to the other lead-in of the outer envelope. Differential thermal expansion is accommodated by sliding of the in-lead through the bushing and flexing of the curved conductor.

In addition to the aforementioned arc tube mounting considerations, it is not feasible, at the present state of the art, to accurately control the length of the alumina tube. Therefore, arc tubes for a given lamp type will vary considerably in length, thereby making it very difficult to provide proper mounting. Further, the presence of a frame wire of sufficient diameter and location to support the arc tube causes a noticeable shadow from the illuminated lamp.

SUMMARY OF THE INVENTION

It is an object of the present invention to provide an arc discharge lamp having improved means for mounting and electrically oonnecting the arc tube within an outer glass envelope.

A further object is to provide an arc discharge lamp including improved arc tube mounting means which compensates for thermal expansion and the tolerance in arc tube lengths in a more economical manner particularly adapted for ease of manufacture.

Yet another object of the invention is to provide an arc discharge lamp having improved arc tube mounting means which reduces shadows due to the mounting structure and minimizes or eliminates fixture noise due to loose mount parts.

These and other objects, advantages and features, are attained, in accordance with the invention, by an arc discharge lamp comprising an hermetically sealed outer glass envelope having a base portion at one end, with a pair of lead-in conductors extending therefrom into the envelope, and a dome portion at the other end opposite the base portion. An hermetically sealed elongated arc tube is disposed coaxially within the outer envelope, the arc tube having first and second external terminals at respective ends which are connected to electrodes disposed within the arc tube. Respective means within the outer envelope electrically connect the pair of lead-in conductors to the first and second terminals of the arc tube. Further means within the outer envelope extends from the base portion for supporting the first end of the arc tube coaxially within the outer envelope, that first end of the arc tube facing the base portion. A coiled spring engaging the second terminal of the arc tube is coaxially disposed in a partially compressed state within the outer envelope between the second end of the arc tube and the dome portion of the outer envelope.

The means electrically connecting one of the lead-in conductors to the second terminal of the arc tube preferably comprises a helically bent conductor wire having a diameter of from about 0.015 inch to 0.014 inch (depending upon lamp wattage and wire material) and extending through the outer envelope beyond the length of the arc tube for significantly reducing shadow effect.

In one specific implementation, the coiled spring has a substantially conical helix portion, and the second arc tube terminal is cylindrical and disposed coaxially with the arc tube. The smaller diameter end of the coil spring is then fitted coaxially onto this cylindrical second terminal, and the larger diameter end of the coil spring bears against the dome portion of the outer envelope. In one embodiment, the dome portion of the outer envelope is substantially disk shaped and the larger diameter end of the coiled spring is constrained in a coaxially centered position within the outer envelope by the side walls of the envelope emerging from the disk shaped portion. In another embodiment, the dome portion of the outer envelope has a dimple formed therein which provides a coaxial cylindrical projection toward the interior of the outer envelope, and the coiled spring has a first cylindrical helix portion comprising a plurality of turns which are fitted coaxially onto the dimple projection of the outer envelope. In this manner the spring is constrained in a coaxially centered position within the outer envelope. Further, as thermal expansion within the operating lamp causes the arc tube length to change with temperature, the coiled spring will either compress or expand to accommodate this linear change with no undue stress on the arc tube. Additionally, the spring compensates for the provided tolerance in arc tube length during lamp assembly. By having the spring in a semi-compressed state, fixture noise due to loose mounts is also eliminated.

BRIEF DESCRIPTION OF THE DRAWINGS

This invention will be more fully described hereinafter in conjunction with the accompanying drawings, in which.

DESCRIPTION OF PREFERRED EMBODIMENTS

Figure 1:
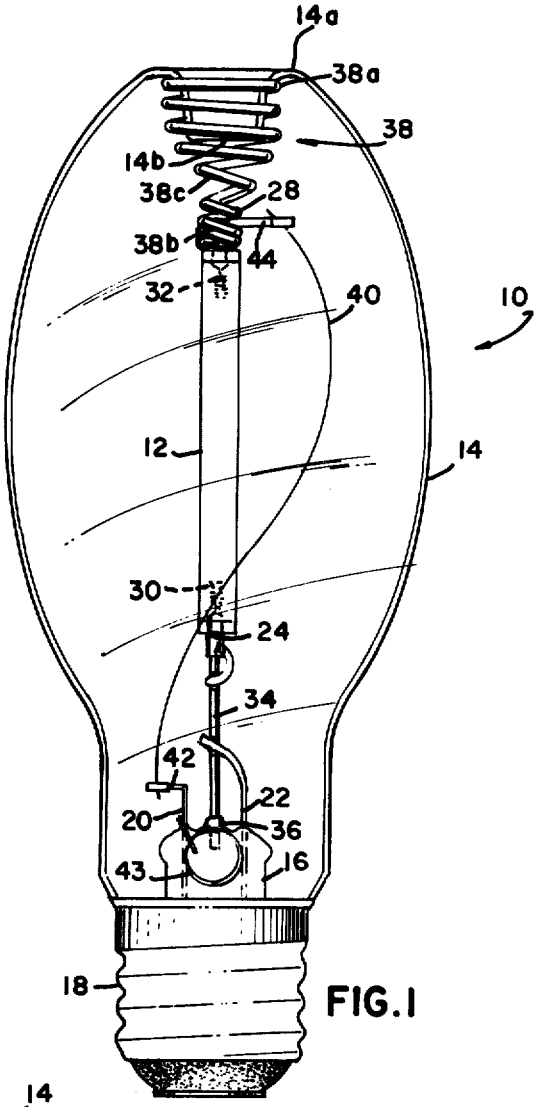
FIG. 1 is an elevational view of one embodiment of an arc discharge lamp having an arc tube mounting construction according to the invention.
Figure 2:
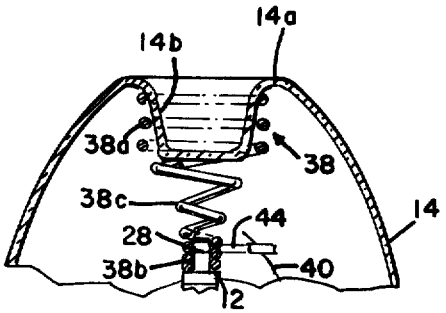
FIG. 2 is an enlarged fragmentary perspective view of the dome portion of the lamp of FIG. 1.

Referring to FIGS. 1 and 2, a high pressure sodium vapor arc discharge lamp 10 according to one embodiment of the invention comprises an hermetically sealed elongated arc tube 12, typically a polycrystalline alumina ceramic, disposed coaxially within an hermetically sealed outer glass envelope 14 having a reentrant stem press 16 and a standard screw base 18 attached to the stem end of the outer envelope. Heavy lead-in conductors 20 and 22 are supported in the stem press 16 and are connected to the base 18 in the usual manner.

The arc tube 10 has a pair of external terminals 24 and 28 at respective ends thereof. The terminals 24 and 28 comprise niobium feed-through tubes which respectively support and are connected to electrodes 30 and 32 within the arc tube 12. The lower niobium tube terminal 24 is secured to and centered by a rod 34 having a lower end inserted into a centering hole 36 in the top of the stem press 16. To secure the rod 34 to the stem press, the lead-in conductor 22 is preformed and welded to the rod 34 as illustrated. Further, in this manner an electrical connection is provided via the conductor 22, conductive rod 34 and terminal 24 to the electrode 30.

In accordance with the invention, a coiled spring 38 is disposed in a partially compressed state within the outer envelope 14 between the top end of the arc tube 12 and the dome portion **14*a* of the outer envelope. According to the embodiment illustrated in FIGS. 1 and 2, the dome portion 14*a* of the outer envelope has a dimple 14*b* formed therein which provides a coaxial cylindrical projection toward the interior of the outer envelope. The coiled spring 38 has a first cylindrical helix portion 38*a* comprising a plurality of turns fitted coaxially onto the dimple projection 14*b* thereby constraining the spring in a coaxially centered position within the outer envelope. The coil spring 38 has a second cylindrical helix portion 38*b* of smaller diameter than the cylindrical helix portion 38*a* and comprising a plurality of turns which fit coaxially onto the cylindrical outer surface of the niobium tube terminal 28, whereby the terminal 28 is securely engaged to coaxially center and stabilize the arc tube 12. The cylindrical helix portions 38*a* and 38*b* of the coiled spring 38 are joined by a conical helix portion 38*c***.

In order to electrically connect the lead-in conductor 20 to terminal 28 and electrode 32 of the arc tube, a helically bent molybdenum conductor wire 40 having a diameter of from about 0.015 inch to 0.040 inch extends beyond the length of the arc tube and has respective ends connected to conductor 20 and terminal 28. More specifically, the helically bent wire 40 has respective nickel hooks 42 and 44 welded at each end. The nickel hook 42 is welded to the lead-in conductor 20, and the other nickel hook 44 is welded to the upper niobium tube terminal 28.

Disposed at the lower end of the lamp, and supported on one of the lead-in conductors 20, 22, are one or more getters 43.

During assembly of lamp 10, the mount (including stem press 16 with the lead-in conductors 20 and 22, arc tube 12 supported by rod 34, and spring 38 engaged upon the end terminal 28 of the arc tube) is inserted into the outer envelope 14 so that the portion **38*a* of the coil spring 38 is slipped over the the dimple 14*b*. Thereafter the outer enveope 14 is selaed to the reentrant stem 16 in the usual manner. The spring 38, as it slides over the dimple 14b, centers the arc tube and mount, and the spring compresses to allow for tolerances in the arc tube length. Further as the arc tube length changes with temperature, the spring will either compress or expand to accommodate the changes with no undue stress on the arc tube. Since the helically bent wire 40** is considerably smaller in diameter than the prior art rigid frame supports or heavier conductor wires, the shadow effect is considerably reduced. Additionally, by having the spring in a semi-compressed state, fixture noise due to loose mounts is also eliminated.

Figure 4:
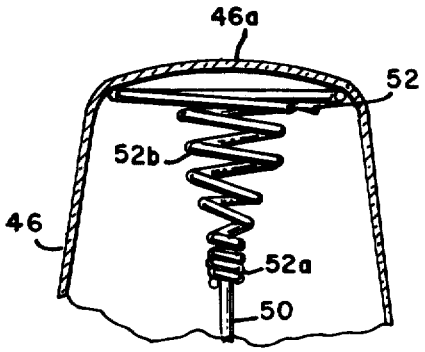
FIG. 4 is an enlarged fragmentary perspective view of the dome portion of the lamp of FIG. 3.
Figure 3:
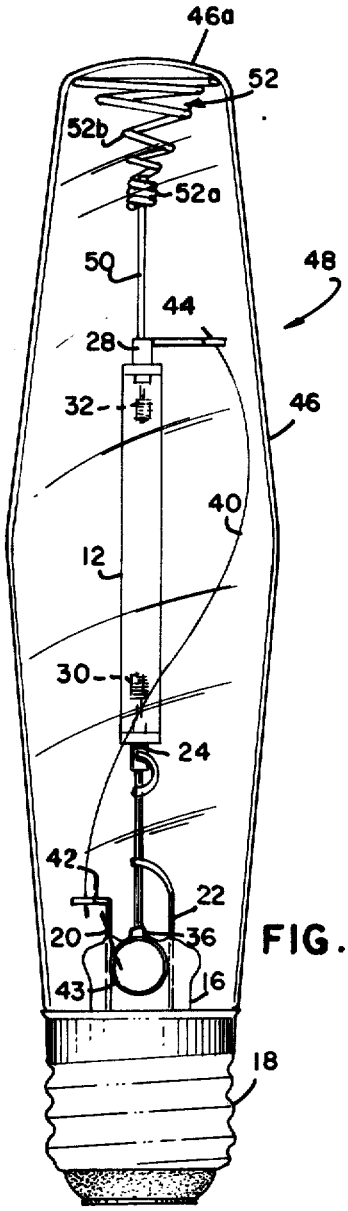
FIG. 3 is an elevational view of another embodiment of an arc discharge lamp having an arc tube mounting construction according to the invention.

The lamp 10 of FIGS. 1 and 2, having a comparatively bulbous envelope 14 with an inwardly projecting dimple 14b at the dome portion, has been referred to as an ED-type bulb. FIGS. 3 and 4 illustrate an alternative embodiment of the mounting structure according to the invention as applied to an arc discharge lamp 48 having a comparatively slender outer envelope 46 with a substantially disk-shaped portion 46a; i.e., there is no inwardly projecting dimple. This is referred to on an E-18 type bulb.

Many of the components of the lamp 48 of FIGS. 3 and 4 are substantially identical to the components of lamp 10 of FIGS. 1 and 2 and therefore are labeled with the same identifying numerals. The electrical connections to the arc tube 12 in the lamp 48 and the supporting arrangement for the lower end terminal 24 are essentially the same as described with respect to lamp 10 of FIGS. 1 and 2. The means for providing thermally compensating centering at the dome portion of lamp 48, however, is somewhat modified. In lamp 48, the terminal of the arc tube facing the dome comprises both the niobium tube 28 and a coaxially extending conductor rod 50 which is fitted into and secured to the niobium tube 28. A coiled spring 52 is coaxially disposed in a partially compressed state within the outer envelope 46 between the end of the arc tube, represented by the extended terminal rod 50, and the disk-shaped dome portion 46a. In this instance the smaller diameter end of the coil spring 52 is fitted coaxially onto the end of the rod 50, and the larger diameter end of the coiled spring is constrained in a coaxially centered position within the outer envelope by the side walls of the envelope emerging from the disk shaped portion 46a. More specifically, the portion of the coiled spring fitted onto the end of the terminal rod 50 comprises a plurality of turns of a cylindrical helix portion 52a, while the portion of the coil spring between the end of the rod 50 and the dome portion 46a spirals as a conical helix portion 52b.

Although the invention has been described with respect to a specific embodiment, it will be appreciated that modifications and changes may be made by those skiled in the art without departing from the true spirit and scope of the invention. For example, the described lamp mount is applicable to other types of arc discharge lamps than the above-discussed high pressure sodium, e.g., mercury and metal halide. Accordingly, the arc tubes may be fused silica, quartz or sapphire or other high temperature, light-transmitting materials. The coiled spring may engage an arc tube terminal (or extension thereof) which comprises a wire, rather than a tube. Different metals may be employed for the component parts than those specifically disclosed. Further, the mount is applicable to a variety of other envelope shapes in addition to the two specific types disclosed herein.

We claim:

1. An arc discharge lamp comprising:

an hermetically sealed outer glass envelope having a base portion at one end, with a pair of lead-in conductors extending therefrom into said envelope, and a dome portion at the other end opposite said base portion;

an hermetically sealed elongated arc tube disposed coaxially within said outer envelope, said arc tube having first and second external conductive terminals at respective first and second ends thereof respectively connected to electrodes disposed within said arc tube at said first and second ends thereof;

respective means within said outer envelope electrically connecting said pair of lead-in conductors to said first and second terminals of the arc tube, respectively;

means within said outer envelope extending from said base portion for supporting said first end of the arc tube coaxially within said outer envelope, said first end of the arc tube facing said base portion;

a coiled spring at one end engaging the second terminal of said arc tube and at the opposite end engaging the dome portion of said outer envelope, said spring being coaxially disposed in a partially compressed state within said outer envelope between said second end of the arc tube and said dome portion of the outer envelope; and the shape of the dome portion of said outer envelope and the shape of said spring engaged therewith being cooperatively configured to constrain said spring in a coaxially centered position within said outer envelope.

2. The lamp of claim 1 wherein said means electrically connecting one of said lead-in conductors to said second terminal of the arc tube includes a helically bent conductor wire having a diameter of from about 0.015 inch to 0.040 inch and extending through said outer envelope beyond the length of said arc tube.

3. The lamp of claim 1 wherein said coiled spring has a substantially conical helix portion, said second terminal is cylindrical and disposed coaxially with said arc tube, the smaller diameter end of said coiled spring is fitted coaxially onto said cylindrical second terminal, and the larger diameter end of said coiled spring bears against the dome portion of said outer envelope.

4. The lamp of claim 3 wherein the dome portion of said outer envelope is substantially disk-shaped, and the larger diameter end of said coiled spring is constrained in a coaxially centered position within said outer envelope by the side walls of said envelope emerging from said disk-shaped portion.

5. The lamp of claim 4 wherein the portion of said coiled spring fitted onto said second terminal comprises a plurality of turns of a cylindrical helix, and the portion of the coiled spring between said second terminal and said dome portion spirals as a conical helix.

6. The lamp of claim 1 wherein the dome portion of said outer envelope has a dimple formed therein which provides a coaxial cylindrical projection toward the interior of said outer envelope, and said coiled spring has a first cylindrical helix portion comprising a plurality of turns fitted coaxially onto said dimple projection, thereby constraining said spring in a coaxially centered position with said outer envelope.

7. The lamp of claim 6 wherein said second terminal has a cylindrical outer surface disposed coaxially with said arc tube, said coiled spring has a second cylindrical helix portion of smaller diameter than said first cylindrical helix portion, said second cylindrical helix comprising a plurality of turns fitted coaxially onto said cylindrical second terminal, and said first and second cylindrical helix portions of said coiled spring are joined by a conical helix portion of said spring.

8. The lamp of claim 7 wherein said means electrically connecting one of said lead-in conductors to said second terminal of the arc tube includes a helically bent conductor wire having a diameter of from about 0.015 inch to 0.040 inch and extending through said outer envelope beyond the length of said arc tube.

9. The lamp of claim 8 wherein said arc tube is composed of polycrystalline alumina, and each of the first and second external terminals thereof comprises a niobium tube.

* * * * *